US008720424B2

(12) United States Patent
Kempf

(10) Patent No.: US 8,720,424 B2
(45) Date of Patent: May 13, 2014

(54) DUAL STIRRUP CROSSBOW

(76) Inventor: James Jay Kempf, Coralville, IA (US)

( * ) Notice: Subject to any disclaimer, the term of this patent is extended or adjusted under 35 U.S.C. 154(b) by 271 days.

(21) Appl. No.: 13/136,267

(22) Filed: Jul. 27, 2011

(65) Prior Publication Data

US 2013/0061836 A1 Mar. 14, 2013

Related U.S. Application Data

(60) Provisional application No. 61/400,774, filed on Aug. 2, 2010.

(51) Int. Cl.
*F41B 5/12* (2006.01)
*F41B 5/18* (2006.01)
*F41B 5/14* (2006.01)

(52) U.S. Cl.
CPC ..... *F41B 5/12* (2013.01); *F41B 5/1469* (2013.01)
USPC ..... 124/25; 124/86; 124/88

(58) Field of Classification Search
CPC ..... F41B 5/12; F41B 5/1469
USPC ..... 124/25, 88, 86
See application file for complete search history.

(56) References Cited

U.S. PATENT DOCUMENTS 3,269,380 A * 8/1966 Stevens ..... 124/25
4,879,987 A * 11/1989 Nishioka ..... 124/25
5,025,771 A * 6/1991 Hanson ..... 124/25
5,119,797 A * 6/1992 Anderson ..... 124/25
5,522,373 A * 6/1996 Barnett ..... 124/25
5,553,596 A * 9/1996 Bednar ..... 124/25
5,630,405 A * 5/1997 Nizov ..... 124/25
6,460,528 B1 * 10/2002 Gallops, Jr. ..... 124/25
6,758,204 B1 * 7/2004 Goff et al. ..... 124/25.6
6,763,817 B2 * 7/2004 Nickell ..... 124/25
6,901,921 B1 * 6/2005 Barnett ..... 124/25
7,017,568 B1 * 3/2006 Smith ..... 124/25
7,178,514 B2 * 2/2007 Chang ..... 124/25
7,328,693 B2 * 2/2008 Kempf ..... 124/25
7,363,921 B2 * 4/2008 Kempf ..... 124/25
7,578,289 B2 * 8/2009 Norkus ..... 124/25.6
7,624,724 B2 * 12/2009 Bednar et al. ..... 124/25
7,624,725 B1 * 12/2009 Choma ..... 124/25
7,743,760 B2 * 6/2010 Woodland ..... 124/25.6
7,748,370 B1 * 7/2010 Choma ..... 124/25
7,810,480 B2 * 10/2010 Shepley et al. ..... 124/25
7,823,572 B2 * 11/2010 Anderson ..... 124/25
7,832,386 B2 * 11/2010 Bednar et al. ..... 124/25
7,836,871 B2 * 11/2010 Kempf ..... 124/25
7,891,348 B2 * 2/2011 Colley ..... 124/25
7,938,108 B2 * 5/2011 Popov et al. ..... 124/25
7,997,258 B2 * 8/2011 Shepley et al. ..... 124/25

(Continued)

*Primary Examiner* — Gene Kim
*Assistant Examiner* — Alexander Niconovich
(74) *Attorney, Agent, or Firm* — Donald J. Ersler

(57) ABSTRACT

The present invention pertains to the field of archery devices, specifically to devices known as crossbows. Historically. crossbows have had a single foot stirrup, centered at the front end of the crossbow, to assist the user in the cocking procedure. Though functional, a single stirrup does not allow the user to naturally center the crossbow with his body while cocking the crossbow, which may cause miss-alignment of the bow string, as well as possible loss of balance and fatigue. By placing a stirrup on both sides of the barrel of the crossbow, the user may use his left foot, right foot, or both feet to cock the crossbow, and the crossbow is automatically centered to the users body.

18 Claims, 3 Drawing Sheets

(56) References Cited

U.S. PATENT DOCUMENTS

| | | | | |
|---|---|---|---|---|
| 8,033,275 | B2 * | 10/2011 | Bednar et al. | 124/25 |
| 8,042,530 | B2 * | 10/2011 | Barnett | 124/25 |
| 8,240,299 | B2 * | 8/2012 | Kronengold et al. | 124/25 |
| 8,425,820 | B2 * | 4/2013 | Pilpel | 264/162 |
| 8,522,762 | B2 * | 9/2013 | Trpkovski | 124/25.6 |
| 2003/0209237 | A1 * | 11/2003 | Nickell | 124/25 |
| 2006/0054150 | A1 * | 3/2006 | Kempf | 124/25 |
| 2006/0086346 | A1 * | 4/2006 | Middleton | 124/25 |
| 2007/0101979 | A1 * | 5/2007 | Bednar et al. | 124/25 |
| 2008/0127956 | A1 * | 6/2008 | Bednar et al. | 124/25 |
| 2008/0168969 | A1 * | 7/2008 | Kempf | 124/25 |
| 2008/0251058 | A1 * | 10/2008 | Colley | 124/25 |
| 2009/0194086 | A1 * | 8/2009 | Kempf | 124/25 |
| 2009/0223500 | A1 * | 9/2009 | Stanziale | 124/25 |
| 2009/0314271 | A1 * | 12/2009 | Ribi | 124/25 |
| 2010/0000503 | A1 * | 1/2010 | Bednar et al. | 124/25 |
| 2010/0132684 | A1 * | 6/2010 | Popov et al. | 124/86 |
| 2010/0170486 | A1 * | 7/2010 | Shepley et al. | 124/25 |
| 2010/0170487 | A1 * | 7/2010 | Kronengold et al. | 124/25 |
| 2010/0170488 | A1 * | 7/2010 | Rasor et al. | 124/25 |
| 2010/0170489 | A1 * | 7/2010 | Shepley et al. | 124/25 |
| 2010/0269807 | A1 * | 10/2010 | Kempf | 124/25 |
| 2011/0197869 | A1 * | 8/2011 | Matasic et al. | 124/25 |

* cited by examiner

DUAL STIRRUP CROSSBOW

This Application claims benefit of 61/400,774 FILED ON Aug. 2, 2010.

A crossbow designed to have two stirrups, one on either side of the basic centerline of the crossbow. The making of a crossbow that allows for the shortest possible overall length, due to the placement of dual foot stirrups on opposing sides of the arrow flight path.

BACKGROUND OF INVENTION

1. Field of the Invention

The present invention relates in general to an improved crossbow and, more particularly, to a crossbow having a dual foot stirrup to reduce overall length, weight, and balance.

2. Description of the Prior Art

Historically, crossbows have been used by hunters, warriors, and target shooters. Cocking the crossbow has been accomplished in numerous ways, but generally by having a single stirrup mounted in the center of the crossbow. Mounted in front of the end of the flight deck, this foot stirrup, as it is called, adds undesirable length to the crossbow, and also adds weight to the very end of the flight deck. Though usually only a several ounces in weight, this added weight is perceived to be far heavier because it is at the far end of the crossbow.

Another method used to cock the crossbow was for the shooter to place their feet against the back side of the limbs of a re-curve style crossbow, one on either side of the flight rail, as illustrated on page 58, FIG. 24 in Sir Ralph Payne-Calloway's "The Crossbow" Though this method functionally worked, it is undesirable due to safety issues of the feet putting uneven pressure on the limbs, and the feet can slip of the limbs while attempting to cock the crossbow.

Barnett Crossbows utilizes a unique single stirrup, U.S. Pat. No. 6,901,921, that is incorporated as part of the riser, but this prior art is attached at the fore end of the flight rail, and still has the undesired length and poor balance.

As shown in Kempf U.S. Pat. No. 7,708,001, a method of creating a shorter crossbow was accomplished by the use of Inverted cam technology. However, the single front mounted stirrup is still a significant drawback.

Another drawback to the single foot stirrups in all prior art is that it places the stirrup in the center of the crossbow. When attempting to cock the crossbow, this placement of the foot stirrup puts the user in an awkward position, creating uneven tension from side to side while cocking the crossbow, and potentially injuring the user due to uneven muscle strain.

SUMMARY OF INVENTION

In an advantage provided by this invention, a crossbow that is provided which is of a low cost, simple manufacture.

- Advantageously, this invention provides a crossbow of a compact, lightweight construction.
- Advantageously, this invention provides a crossbow of reduced overall length, when using a ratio of length of power stroke to overall length of the crossbow.
- Advantageously, this invention provides a crossbow with an increased power stroke.
- Advantageously, this invention provides a crossbow which is easier to cock.

The current invention solves many of the historical and current disadvantages of the single front mounted foot stirrup. By placing the Dual Stirrups as shown, the overall length of the crossbow is reduced by putting the stirrups on the sides of the fore end of the flight deck, instead of attaching to the end of the flight deck as in Barnett #6901921. A reduction of weight at the fore end of the crossbow gives better overall balance and a perceived weight reduction. Incorporating the stirrups with the crossbow riser adds a great deal of structural strength and rigidity. By having 2 stirrups as shown, the shooter has the ability to keep the crossbow centered while cocking it, and may use the left foot, right foot, or both feet.

The drawings of the current invention show one example of an attachment means for the bow limbs, using a typical type limb pocket. By having two stirrups as shown, the pivot point of the limbs can be moved towards the mid-point of the limb, allowing the reward portion of the stirrups to act as the support for said pivot point. The current invention can be used on all manner of crossbows, including but not limited to re-curve crossbow, Inverted cam crossbows, and standard cam crossbows.

Said riser and integrated dual foot stirrups may be made from a plurality of methods and materials, such as a machined metal forging, a machined metal extrusion or billet, injection molded from many different composites, or a combination of these, as well as others. Said riser and dual foot stirrups may also be integrated with the barrel, also known as the flight deck, and or a 1 or multi piece stock, forming an extremely strong, lightweight, and inexpensive crossbow. Said riser, if made from a composite, may also be sonic welded to the barrel and or stock.

BRIEF DESCRIPTION OF DRAWINGS

The present invention will now be described, by way of example, with reference to the accompanying drawings in which.

DETAILED DESCRIPTION OF THE PREFERRED EMBODIMENT

Figure 1:
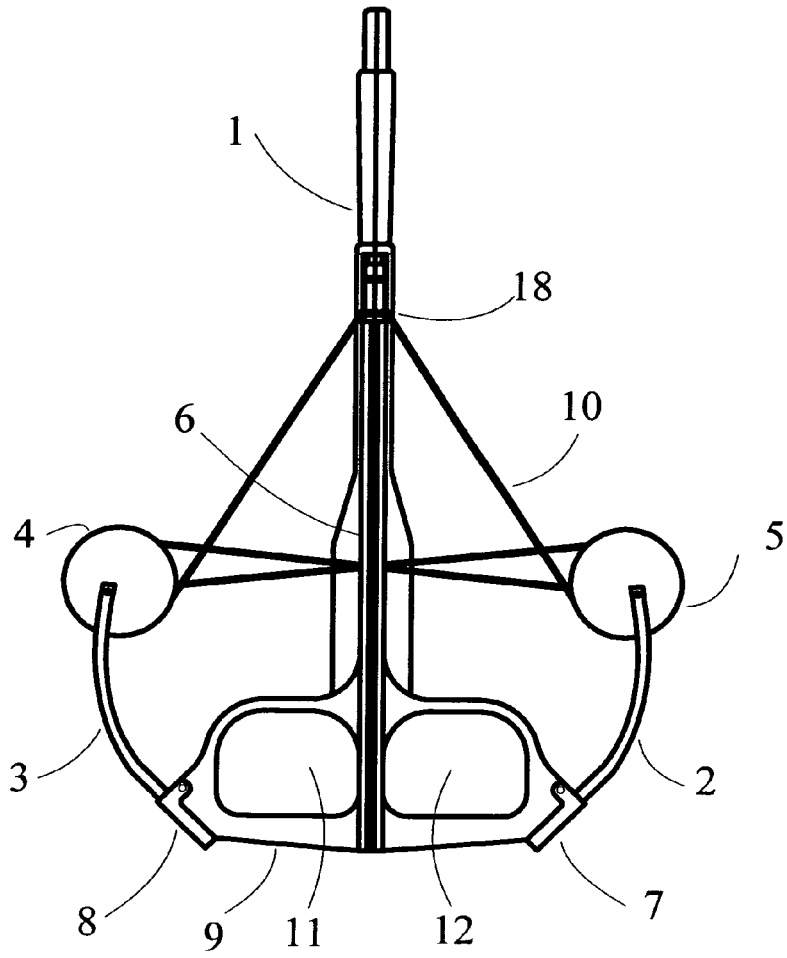
FIG. 1 is a top view of the present invention where the dual foot stirrup crossbows utilizes Inverted cam technology.

A crossbow of the present invention is shown in FIG. 1 through 4. FIG. 1 is a top view a cocked dual stirrup crossbow utilizing Inverted cam technology. It is showing the riser frame 9 and very distinctive openings 11 and 12 that make the dual foot stirrups. The riser frame 9 is connected to the crossbow stock 1 by the barrel 6, which can be integrated into the riser frame, or the stock. The barrel 6 may have the projectile rest upon it, or float above it. The limb assemblies 2 and 3 are coupled to the riser frame 9 with limb pockets 7, 8, and the opposite ends of the limbs have string guides 4 and 5 coupled to them. The bow string 10 is held in the cocked position by the retaining means 18.

Figure 2:
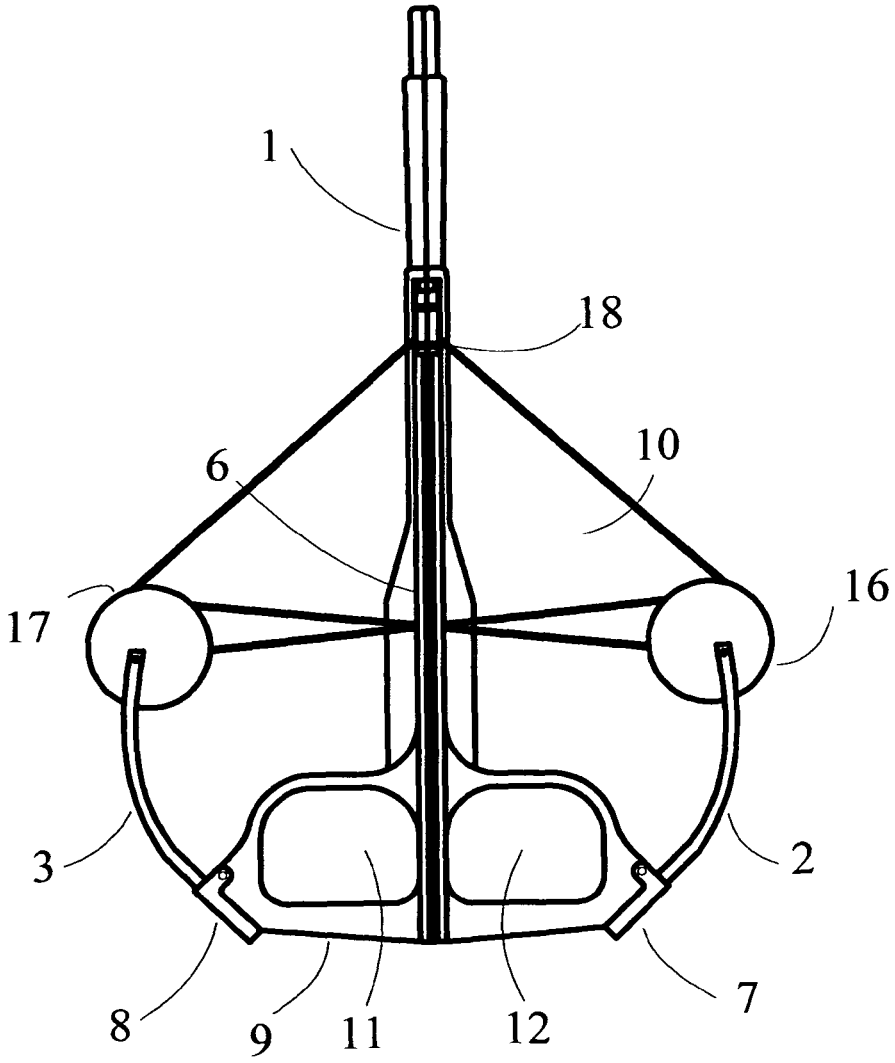
FIG. 2 is a top view of the present invention where the dual stirrup crossbow utilizes conventional cam technology.

FIG. 2 is a top view of a cocked dual stirrup crossbow that utilizes standard cam technology with cams 16, 17 terminating the limbs 2, 3.

Figure 3:
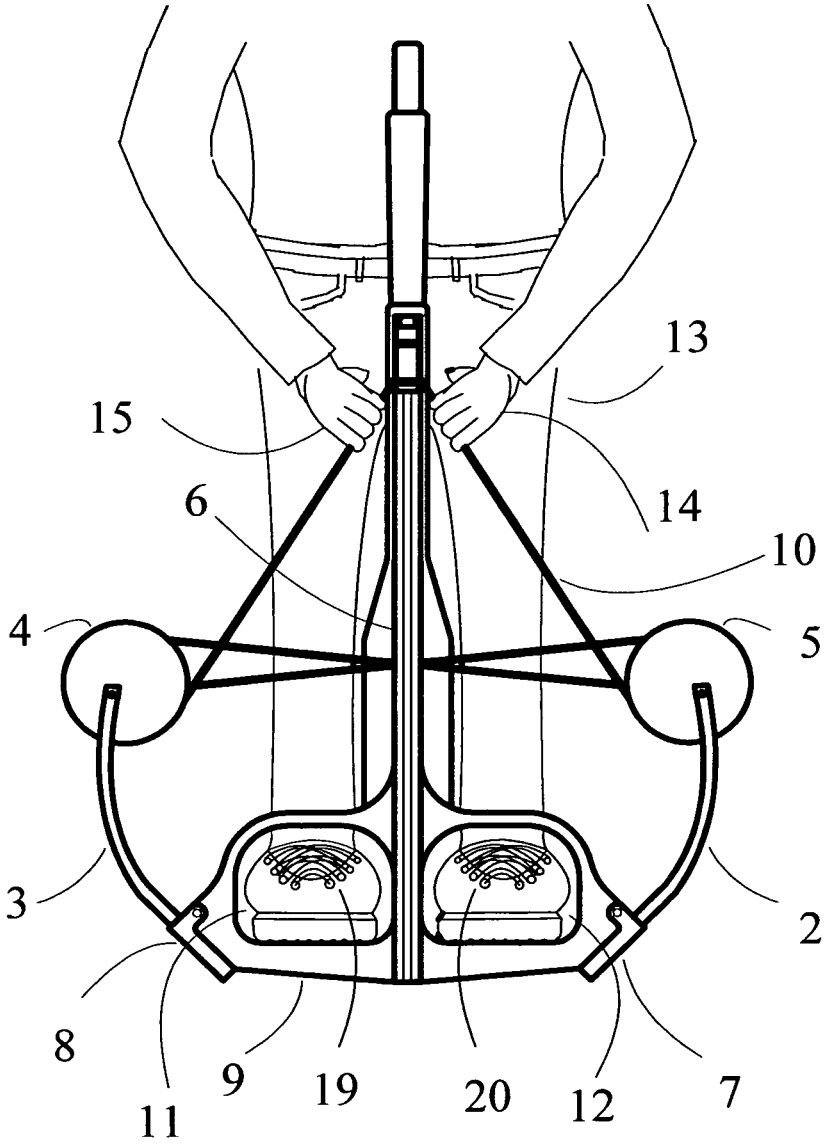
FIG. 3 illustrates the user cocking the crossbow with both feet in the stirrups.

FIG. 3 illustrates a user cocking the dual stirrup crossbow, where the user 13 places both feet 19 and 20 with the openings 11 and 12 of the riser frame 9, centering the stock 1 with his body, He has grasped the bowstring 10 with his hands 14 and 15 and engaged said string with the retaining means 18.

What I claim is:

1. A dual stirrup crossbow comprising:

a barrel having a first end and a second end;

a riser frame includes a first foot stirrup opening and a second foot stirrup opening, said first end of said barrel extends from said riser frame, said barrel having a longitudinal axis, said first foot stirrup is disposed on a first side of said longitudinal axis, said second foot stirrup is disposed on a second side of said longitudinal axis, material is located between said first and second stirrup openings, wherein said first and second stirrup openings fully encompass a foot inserted therein;

a first limb assembly extends from a first side of said riser frame, a second limb assembly extends from a second side of said riser frame;

a first cam is rotatably retained on an end of said first limb assembly, a second cam is rotatably retained on an end of said second limb assembly; and a bow string is retained on said first and second cams.

2. A dual stirrup crossbow of claim 1, further comprising:

a crossbow stock extends from said second end of said barrel.

3. A dual stirrup crossbow of claim 1, further comprising:

a retaining device is located on said barrel for releasably retaining a portion of said bow string.

4. A dual stirrup crossbow of claim 1 wherein:

a projectile rest is located on or located adjacent said barrel.

5. A dual stirrup crossbow of claim 1 wherein:

said crossbow utilizes conventional cam technology.

6. A dual stirrup crossbow of claim 1 wherein:

said crossbow utilizes inverted cam technology.

7. A dual stirrup crossbow comprising:

a barrel having a first end and a second end;

a riser frame includes a first foot stirrup opening and a second foot stirrup opening, said first end of said barrel extends from said riser frame, said barrel having a longitudinal axis, said first foot stirrup is disposed on a first side of said longitudinal axis, said second foot stirrup is disposed on a second side of said longitudinal axis, wherein said first and second foot stirrups fully encompass each foot separately;

a first cam is rotatably retained on an end of said first limb assembly, a second cam is rotatably retained on an end of said second limb assembly; and a bow string is retained on said first and second cams.

8. A dual stirrup crossbow of claim 7, further comprising:

a crossbow stock extends from said second end of said barrel.

9. A dual stirrup crossbow of claim 7, further comprising:

a retaining device is located on said barrel for releasably retaining a portion of said bow string.

10. A dual stirrup crossbow of claim 7 wherein:

a projectile rest is located on or located adjacent said barrel.

11. A dual stirrup crossbow of claim 7 wherein:

said crossbow utilizes conventional cam technology.

12. A dual stirrup crossbow of claim 7 wherein:

said crossbow utilizes inverted cam technology.

13. A dual stirrup crossbow comprising:

a barrel having a first end and a second end;

a riser frame includes a first foot stirrup opening and a second foot stirrup opening, said first end of said barrel extends from said riser frame, said barrel and said riser frame are fabricated from a single piece of material, said barrel having a longitudinal axis, said first foot stirrup is disposed on a first side of said longitudinal axis, said second foot stirrup is disposed on a second side of said longitudinal axis, wherein said first and second foot stirrups fully encompass each foot separately;

a first limb assembly extends from a first side of said riser frame, a second limb assembly extends from a second side of said riser frame;

a first cam is rotatably retained on an end of said first limb assembly, a second cam is rotatably retained on an end of said second limb assembly; and a bow string is retained on said first and second cams.

14. A dual stirrup crossbow of claim 13, further comprising:

a crossbow stock extends from said second end of said barrel.

15. A dual stirrup crossbow of claim 13, further comprising:

a retaining device is located on said barrel for releasably retaining a portion of said bow string.

16. A dual stirrup crossbow of claim 13 wherein:

a projectile rest is located on or located adjacent said barrel.

17. A dual stirrup crossbow of claim 13 wherein:

said crossbow utilizes conventional cam technology.

18. A dual stirrup crossbow of claim 13 wherein:

said crossbow utilizes inverted cam technology.

* * * * *